US005136867A

United States Patent [19]

Züger

[11] Patent Number: 5,136,867

[45] Date of Patent: Aug. 11, 1992

[54] AUTOMATIC FRAME BENDING MACHINE FOR BENDING OF STEEL RODS OR BAND STEEL

[75] Inventor: Jakob Züger, St. Gallen, Switzerland

[73] Assignee: Spuhl AG, Fed. Rep. of Germany

[21] Appl. No.: 644,938

[22] Filed: Jan. 22, 1990

Related U.S. Application Data

[62] Division of Ser. No. 359,748, May 8, 1989, Pat. No. 5,054,178.

[30] Foreign Application Priority Data

Sep. 9, 1987 [GR] Greece ..... 87.1408

[51] Int. Cl.[5] ..... B21D 7/024

[52] U.S. Cl. ..... 72/294; 72/307; 72/217; 72/426

[58] Field of Search ..... 72/307, 306, 294, 321, 72/217, 388, 426, 152, 149, 161, 171, 403

[56] References Cited

U.S. PATENT DOCUMENTS

| | | | |
|---|---|---|---|
| 2,387,688 | 10/1945 | Spahr | 72/171 |
| 3,563,283 | 2/1971 | Tufektshiev | 72/307 |
| 3,823,749 | 7/1974 | Ritter | 140/105 |
| 4,161,110 | 7/1979 | Ritter | 72/307 |
| 4,249,407 | 2/1981 | Fogleman | 72/217 |
| 4,280,350 | 7/1981 | King et al. | 72/7 |
| 4,335,758 | 6/1982 | Williams | 72/161 |
| 4,485,658 | 12/1984 | Stewart | 72/307 |
| 4,590,779 | 5/1986 | Stange et al. | 72/294 |
| 4,633,698 | 1/1987 | Oetiker | 72/171 |

FOREIGN PATENT DOCUMENTS

| | | | |
|---|---|---|---|
| 0032656 | 7/1981 | European Pat. Off. . | |
| 0198984 | 10/1986 | European Pat. Off. . | |
| 258109 | 3/1988 | European Pat. Off. | 72/307 |
| 2723846 | 12/1977 | Fed. Rep. of Germany . | |
| 3436285 | 4/1985 | Fed. Rep. of Germany | 72/307 |
| 2472523 | 7/1981 | France . | |
| 2553314 | 4/1985 | France . | |
| 8700096 | 9/1987 | PCT Int'l Appl. . | |

*Primary Examiner*—Daniel C. Crane

*Attorney, Agent, or Firm*—Baker, Maxham, Jester & Meador

[57] ABSTRACT

An automatic frame bending machine is disclosed for bending off rod steel or steel bands, and a process and device for producing spring mattresses. The purpose of the invention is to design a frame bending machine with which frames of the most diverse types can be automatically produced without risk of material losses or of deforming the frames. The frame bending machine should also be easy to integrate in an assembly line. For this purpose, a spool is provided, after which the steel passes through a wire straightener composed of a rotor and rollers, measurement and traction rollers linked to the bending device, cutting means and a centering metal sheet. Hydraulic motors controlled by a microprocessor from a control panel are provided for driving and bending.

4 Claims, 4 Drawing Sheets

15, 15a, 15b, 15c

AUTOMATIC FRAME BENDING MACHINE FOR BENDING OF STEEL RODS OR BAND STEEL

Figure 1:
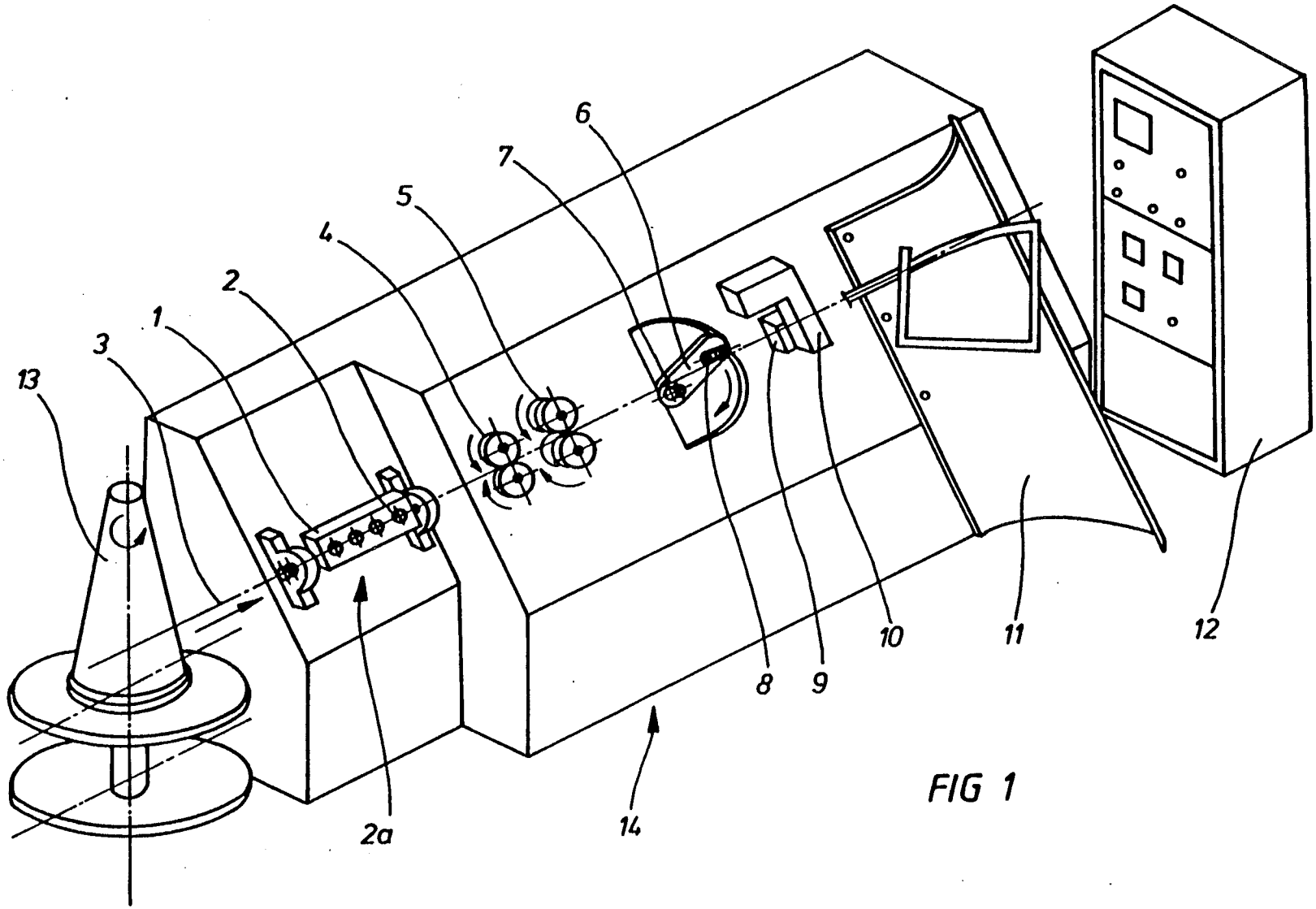

This is a divisional of copending application(s) Ser. No. 07/359,748 filed on May 8, 1989, now U.S. Pat. No. 5,054,178, issued Oct. 8, 1991.

Subject of the invention is an automatic frame bending machine used for bending steel rods or band steel as well as a process and device for the production of innersprings for mattresses and upholstered furniture.

The disadvantage of the frame bending machines known so far is the possiblity of material losses during adjustment attempts. Furthermore, with the frame bending machines known so far the change-over to other frame shapes was expensive, since re-alignment, particularly close to the angels, was required during the production. It was also very difficult to integrate the known frame bending machines into production lines.

The objective of this invention is to design a frame bending machine in such a way that frames of the most diverse types can be automatically produced with ease and without the danger of material losses or the danger of distortion of the frames. Furthermore, the frame bending machine should be easily integrated in a production line for the production of innersprings for mattresses and upholstered furniture.

The nature of the invention is in the special combination of the individual aggregates which are consecutively or in series connected with the micro processor controls and the hydraulic aggregate, whereby the individual aggregates are synchronized and arranged in the plane of the steel rods or band steel.

In one of the design versions of the frame bending machine the traction rollers pull the steel rods to be aligned through the rollers of the wire alignment device, whereby the rotor arranges the angles of the frame to be bent in a plane by twisting the steel rods or the band steel respectively.

Thus is achieved that the wire alignment device operates without wear and tear and, furthermore, that the frames remain flat due to the position of the wire alignment device, but particularly due to the special arrangement of the feeder and bending aggregate, so that subsequent re-alignment is no longer required.

In one advanced design of the-frame bending machine the bending device consists of a pin which pivots around a fixed axis, whereby the steel rods or bands to be bent run between said axis and pin.

The pin on a swivel arm is driven by a hydraulic motor designed to obtain high accuracy throughout the entire range.

In a further design the bending device consists of a center disk and a bending roller, whereby the center disk is designed with a groove around its circumference for the steel rods or bands to be bent, and whereby the bending roller—in accordance with the angle to be bent—is led around the outer circumference of the center disk in the area of swivel arm.

Thus, high bending accuracy in the desired angle range is achieved, whereby setting or re-setting of the angle is easily accomplished from the front, due to the mounting of the center disk or the bending roller respectively.

The design of the bending device is such that the cutting device in the area of the diverters in extension of the bending device is opposite to the moving direction of the bending device, whereby the steel rods or bands to be cut run in a counter bearing.

This results in precise guidance of the steel rods or bands in a privileged direction with cuts of millimeter accuracy.

The centering plate is located at the end of the frame bending machine, semicircular and preferably arched upwards.

This results in limiting the length of the frame bending machine, since the completely bent frame parts are caught by the centering plate and are arched upwards to the front without causing a distortion of the completed frames.

Thus it is possible to use a much smaller space for the frame production than was previously required.

With the integration of the automatic frame bending machine as per the invention into a production line, the subject invention also covers a process for the production of innersprings for mattresses or upholstered furniture, whereby an innerspring is to be equipped with a frame each, both at the upper and lower side.

Some of the processes and devices known so far require quite a bit of additional manual labor, particularly in the process of attaching the innerspring to the frame parts. In particular, the known devices and processes do not allow fast synchronous operation.

Therefore, the objective is to design the process and the device in such a way that a production line is created for fast synchronous production of innerspring mattresses with as little manual labor as possible.

The nature of this process is identified by the fact that the frames are produced and deposited in one direction and that the innerspring is approaching from another direction. The removal follows in a third direction. Thus, fast synchronous production results in which individual steps of the process for the production of the innerspring mattress are arranged in directions which are vertical to each other.

An advantageous version of this process uses two frames simultaneously in an even faster synchronous production sequence, whereby the first frame is deposited on the clamping table, where the underside is attached to a first innerspring, and the first innerspring with the first frame is moved into a waiting position in one direction, and that a second innerspring is clamped to a second frame on the clamping table, from where it is moved into a waiting position in another direction, that the first innerspring is turned and returned to the clamping table, where it is connected to a third frame and, subsequently, moved away, and that the second innerspring is turned and returned to the clamping table, where it is connected to a fourth frame and then moved on.

A particularly fast production sequence is thus achieved, due to the fact that the partially assembled innerspring mattresses are moved back and forth in the area of the production station in a kind of waiting position. Thus, two innerspring mattresses can simultaneously be produced and removed.

The device for the production of innerspring mattresses entails an innerspring, which is to be equipped with one frame each on its upper and lower side, and the device particularly provides that at the beginning of a production line, a frame bending machine is provided in one direction as well as a butt welding device or a clamping device and, furthermore, a feeder aggregate with stacking arrangement for the frames and another feeder device to the clamping table in a production station, whereby a turning and transport device is provided above the clamping table, that, with reference to the clamping table, a transport device for innersprings from another direction is provided, that the clamping table is equipped with four clamping heads, and that in a different direction an additional table is provided for removal by means of the turning and transport device.

The nature of the device is to first provide the production and feeder stations for the frame production in one direction of the production line.

The actual production station is located in another direction, whereby the actual production on the clamping table occurs approximately in the center of the production station at the end of the feeder for the frames. In connection with the turning and feeder devices the entire innerspring mattress can be produced on a single table, here the clamping table, whereby long transports are eliminated to achieve fast synchronous production.

In another design version the production line is T-shaped with the bending station at one end, with feeder and frame deposit in one direction and the arrangement of the production station in another direction, vertical to the first, whereby the production station consists of the clamping table with clamping heads as well as the turning and transport device in the center and the transport devices for the innersprings and for removal on the sides.

Here the frame production and the deposit are arranged in one direction, whereas the production station is arranged vertically thereto. By moving the partially completed innerspring mattresses back and forth in connection with the turning of the parts and subsequent deposit and further assembly very fast synchronous production is achieved.

Subject of this invention is not only given by the subject of the individual patent claims, but also by the combination of the individual patent claims. All information given, including the summary and particularly the three-dimensional figures shown in the drawings, is claimed to be substantial to the invention, as far as it is new compared to the state of the art, either individually or in combinations thereof.

In the following, the invention is explained in more detail with the help of several design versions shown in the drawings. The drawings and their descriptions detail further substantial characteristica and advantages of the invention.

Figure 2:
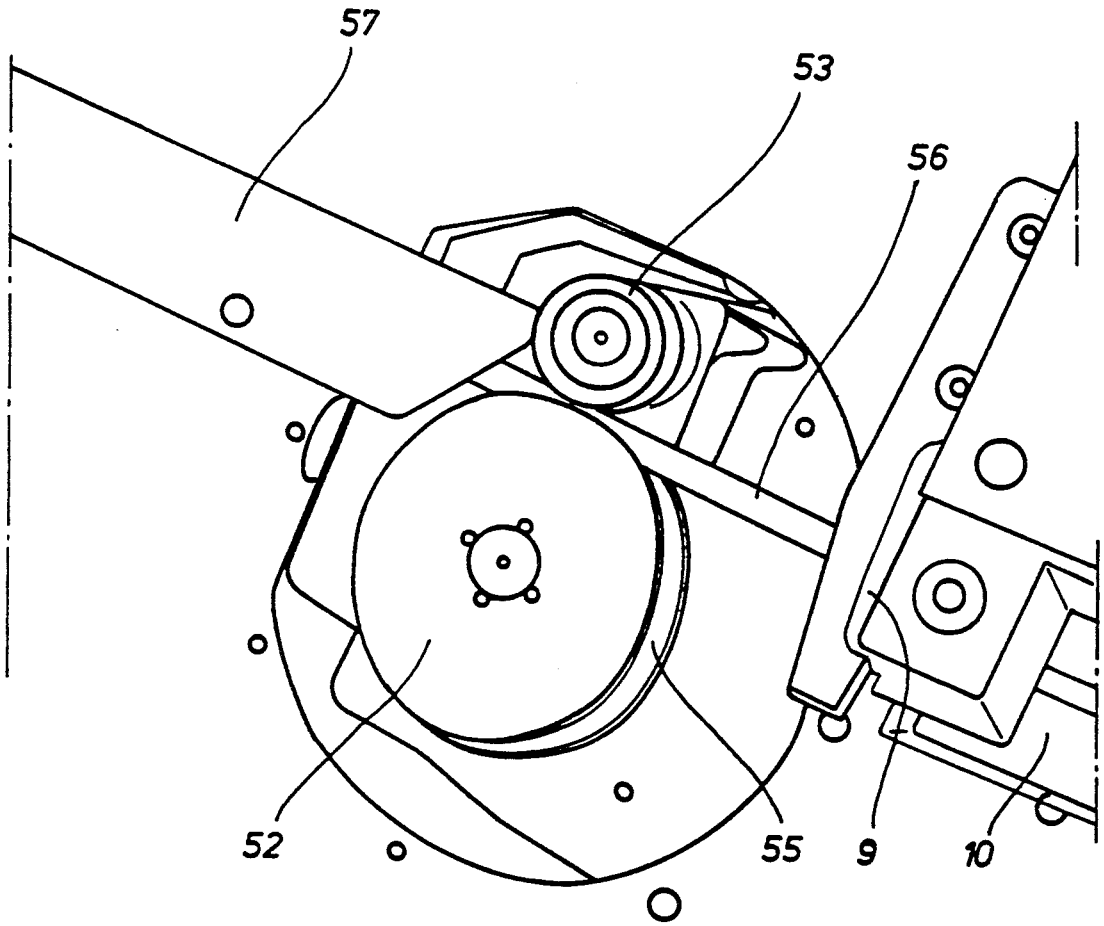
Figure 3:
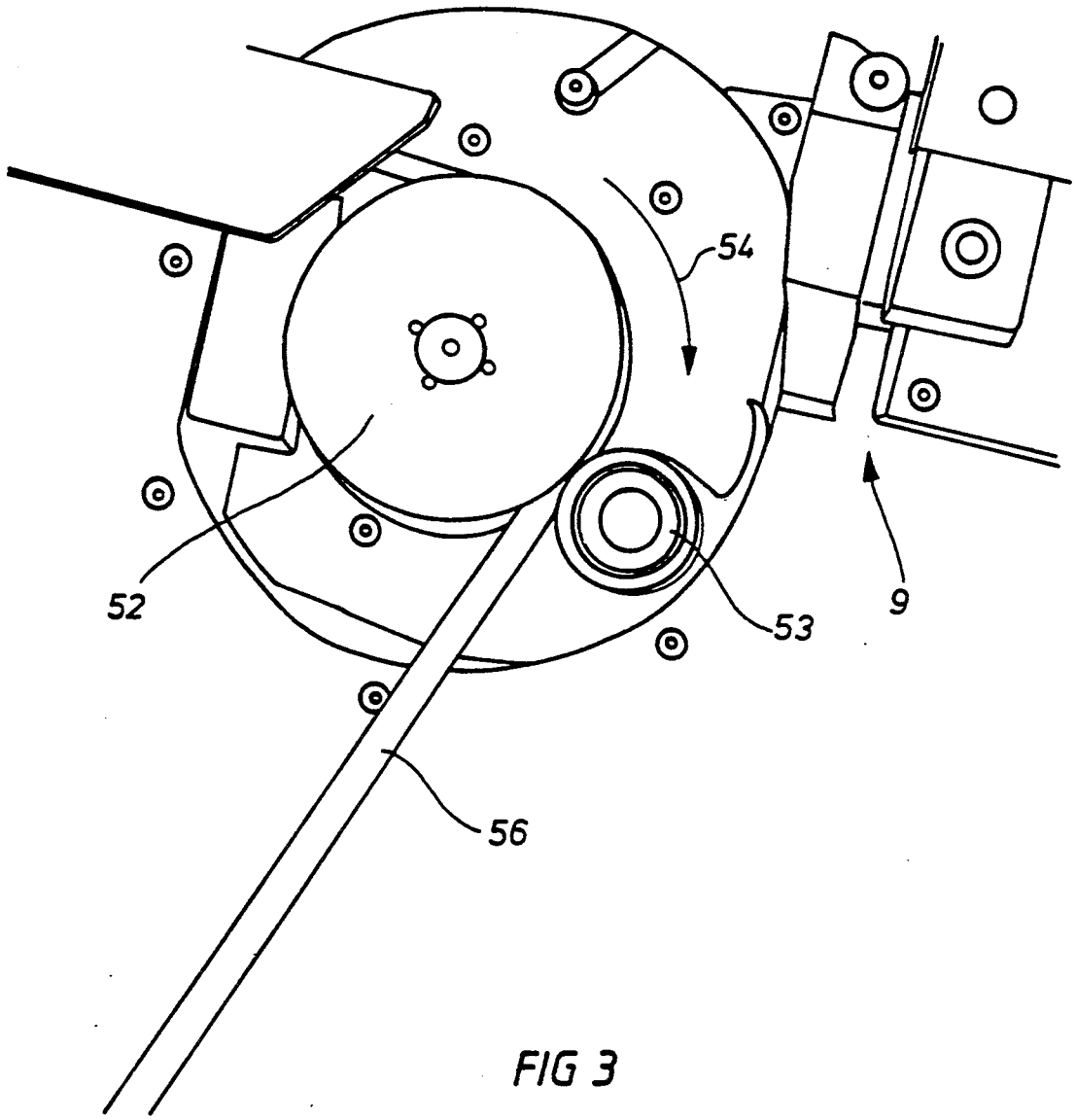
Figures 4, 4A, 4B:
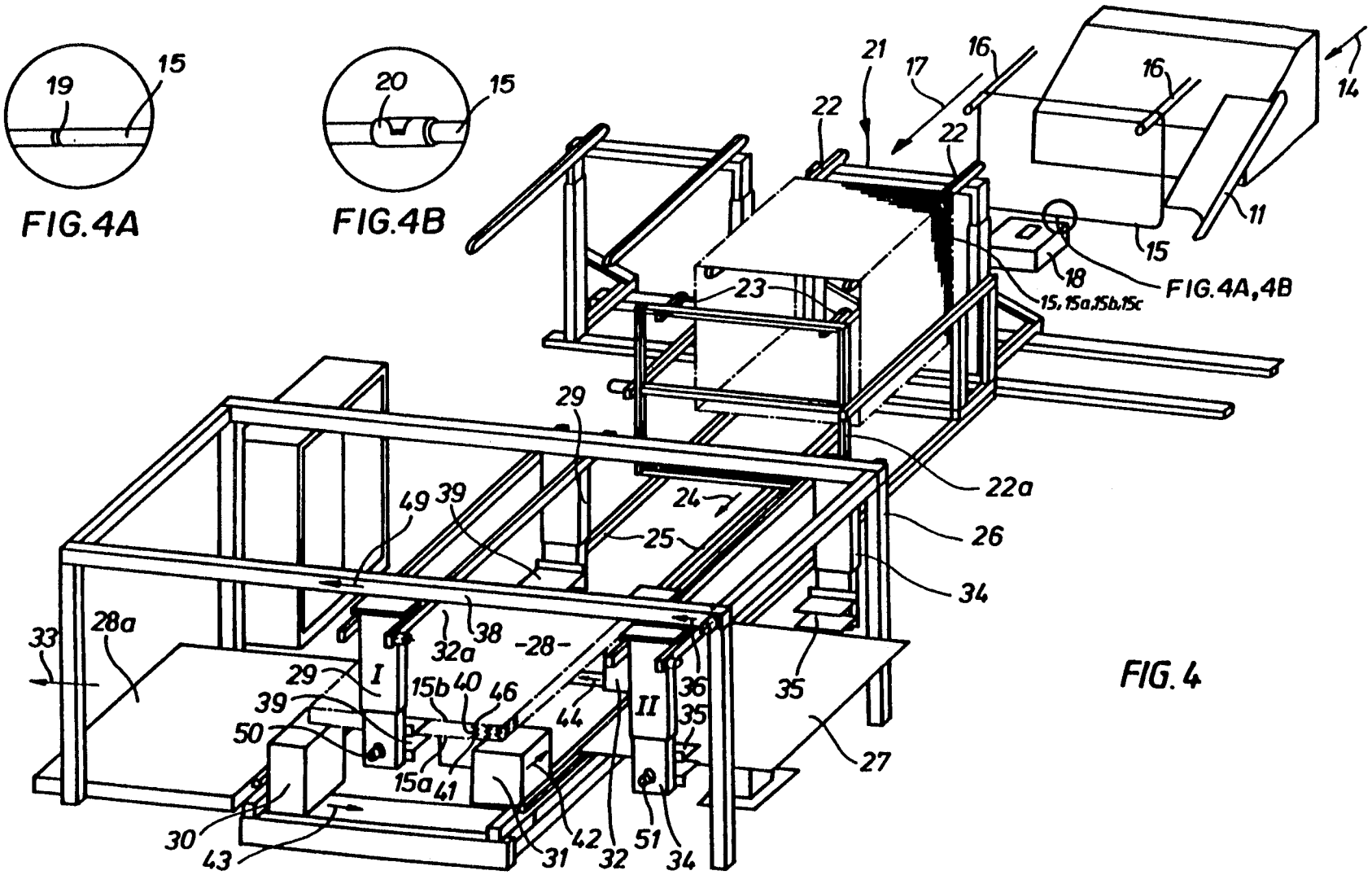

Shown are:

FIG. 1: A perspective drawing of the frame bending machine as per the invention;

FIG. 2: A detail of a bending device prior to bending of the steel rod or band steel in a first design version;

FIG. 3: The bending device as per FIG. 2 after the bending process;

FIG. 4: A production line for the production of inner-spring mattresses, including a frame bending machine as per the invention.

FIG. 4A: Is magnified showing of the frame joint butt welded; and

FIG. 4B: Is magnified showing of the frame joint enclosed by a clamp.

As per FIG. 1 the automatic frame bending machine 14 consists of a reel 13 in front of the machine from where the wire 3, steel rods in particular, runs into a wire alignment device 2a or is drawn into same by means of traction rollers 5 respectively. In case band steel is used, a wire alignment device is not required.

In front of the traction rollers 5, which are arranged in pairs, measuring rollers 4 without own drive are also arranged in pairs; they are used to precisely measure the incoming wire, which is to be cut by cutting device 9, following the bending process.

In a first design version as per FIG. 1 the bending device 6 consists of a fixed axis 7, around which a pin 8 pivots by means of a hydraulically driven swivel arm, whereby the wire or band material is bent by pivoting the pin 8. Hereby both the axis 7 and the pin 8 can be equipped with suitable grooves.

Following the bending device 6 is a cutting device 9 with a special fixed counter bearing 10, which also serves as a band guide.

After completion of the bending process the parts are caught by a centering plate 11, are centered and arched upwards, in order to limit the length of the machine without limiting its effectiveness.

The machine itself, particularly its drive and bending aggregates, the wire guide and the measuring rollers, are controlled by a micro processor in the operating unit 12.

For the automatic frame bending machine 14 a rotor 1 with rollers 2 is provided, whereby the wire 3 or the steel rods or band steel run through the rollers 2, which may also be driven. In connection with one clockwise rotation of rotor 1 the wire or the steel band respectively is aligned in such a way that, upon completion of the bending process, the frame is flat with true angles, and no additional labor is required.

A special advantage is that the wire alignment device 2a operates without wear and tear, particularly without wire or band steel friction, whereby, in connection with a twisting of the wire to be guided over the rotor 1, very simple and precise alignment of the wire material is achieved.

The measuring rolls 4 consist of a pair of rollers which are used for the electronic measurement of the length of the pulled or pushed wire. The axis of the electronic pick-up, which is used for the measurement, is connected to the shaft of one of the rollers.

The second pair of rollers serves as traction rollers 5, pulling or pushing the wire or the band material respectively, in order to determine the lengths required for the frame production. As soon as the required length is reached, the traction rollers act as brakes with millimeter accuracy for the material, so that the respective bending process may occur with the same accuracy.

The traction rollers 5 are driven by a hydraulic motor which is controlled by the operating unit 12. Two speeds are used for the length determination with millimeter accuracy, whereby the lower speed is achieved by throttling the respective oil throughput. The lower speed is used to run the last centimeter of each length. Thus, the inertia of the unit is substantially reduced and a measurement with millimeter accuracy is achieved in connection with the feed motion.

The bending device 6 is also driven by a hydraulic motor, whereby high accuracy is achieved over the entire range.

The cutting device 9 is also driven by a hydraulic cutter—whereby the counter bearing 10 of the cutting device 9 is arranged in such a way that-following the bending process—the wire runs through this guide, so that, on one hand, a wire running through is not interfered with and, on the other hand, that it can be cut with high accuracy.

The semicircular plate or the centering plate 11 respectively limits the spreading of the completed frames, whereby the completed frames are elastically bent away without this resulting in a lasting distortion. Thus it is possible to erect the frame bending machine in a rather small space.

Electronic programming of the frame bending machine is done with the operating unit 12. Operation of the wire alignment device 2*a*, traction rollers 5 and measuring rollers 4 as well as bending device 6 and cutting device 9 is pre-programmed, and the computer controls all automatic functions.

The operation of the automatic frame bending machine is as follows:

Wire 3—or steel rods or band steel respectively—is unwound off reel 13 and runs through the rotor 1 in a straight line, whereby the traction rollers 5 and the measuring rollers 4 determine the length of each side of a frame. Prior to reaching the determined length, the feeder speed is reduced, so that the inertia is limited, and the wire can be processed with the highest possible accuracy.

After wire 3 stops, it is bent at the required angle by the bending device 6. The swivel arm of the bending device returns to its basic position, the wire is further advanced, and the bending process is repeated until the programmed shape is obtained.

Finally, the cutting device 9 cuts the wire, and the process of the wire traverse controlled by operating unit 12 starts over.

In case band steel is used instead of wire with a round cross section, the process is repeated with the exception of the wire alignment device, since alignment in a straight line is not necessary when band steel is used.

FIG. 2 shows another version of bending device 6, where the steel rods or bands are bent around a disk.

As per FIG. 2 a fixed roller or a center disk 52 respectively is provided with a groove 55 for the round or band steel.

The steel rod or band steel runs in groove 55 and is bent by bending roller 53, whereby the bending roller 53 touches the center disk 52 and is then pivoted in the direction of arrow 54 in FIG. 3, i.e. the bending roller 53 moves around the fixed center disk 52 and, therefore, bends the steel rod or the band steel at the desired angle.

FIG. 3 shows how bending roller 53 is moved around the circumference of center disk 52, preferably by means of a swivel arm, in order to angle the steel rod or band steel.

FIG. 1 and particularly FIGS. 2 and 3 show—in extension of the bending device—the cutting device 9 with the counter bearing 10, which are arranged in a precise line with band guide 57 for the steel rod or band steel, so that the material runs in the counter bearing 10 at all times—also following the bending process—and can easily be cut by the hydraulic-driven cutter above the steel rod or band steel.

Hereby it is of particular advantage that the steel rod or band steel, even following the bending process, in connection with band guide 57 is again caught in the counter bearing 10, thus ensuring trouble-free operation of the frame bending machine.

FIG. 4 shows the integration of the frame bending machine as per the invention in an automatic production line.

The bending machine 14 at the beginning of the production line is hereby controlled by certain process parameters from the operating unit 12, whereby bending profiles can be produced at random.

With the micro processor control of the frame bending machine in connection with operating unit 12, rectangular or curved profiles can be produced in a way that the frame joints either overlap or are butt joints.

Furthermore, triangular profiles can also be produced.

The frame bending machine is also capable of producing closed round profiles, especially with curved or angular shapes at the circumference, such as rosettes or multi-sided profiles. It is also possible to produce winding profiles or to add rectangular or angular notches to a basically straight bending material.

As per FIG. 4 one has the option to connect either a butt welding device 18 or a clamping device to the frame bending machine.

Of particular interest is the fact that two frames in an arrangement over each other can simultaneously be bent with the frames bending machine, thus achieving a faster production process. This requires the use of 2-core band steel contrary to 1-core band steel or steel rods.

The frame bending machine 14 includes the electronic controls by micro processor, providing easy program input by means of dialogue (12 seconds), whereby up to 100 different frame shapes can be stored and selected with the help of a code number (approx. 3 seconds).

For the use of steel rods the special wire alignment device 2*a* prevents the distortion of the frames, thus there is no material loss. Also, material loss due to adjustment attempts is eliminated, since the first frame and all subsequent frames are completed as programmed.

The frame bending machine 14 as per FIG. 4 can easily be integrated or combined with a production line, providing automation of the production of innersprings.

The installation of the frame bending machine 14 is easy, and no effort is wasted on changing the frame configurations, i.e. only a pushbutton-input of a new code number is required to manufacture a different kind of frame.

Another advantage is the integration of a hydraulic aggregate in the frame bending machine, thus achieving a compact design.

Due to the special arrangement of the wire alignment device 2*a* in connection with the other aggregates of the frame bending machine, particularly with the arrangement of the traction rollers and the cutting device in one plane in which the bending device 6 is also located, the frames remain flat after the bending process, and subsequent alignment is not required.

As shown in FIG. 4 the completely bent frame 15 is transported away from the bending device 14 via two feeders 16 in the direction of arrow 17. The bending device 14 is equipped with a centering plate 11, which is tilted downwards, centering the frame 15 on the diverter/feeders, allowing for parallel forward motion in the direction of arrow 17.

As shown in FIG. 4 the frame 15 is transported to a butt welding device 18, where the frame joint is either welded by the butt welding device 18 to form frame joint 19 (FIG. 4*a*) or where the frame joint 19 receives a clamp 20, which fully closes the frame joint 19 (FIG. 4B).

This is an alternative, either the butt weld machine 18 is provided, which welds the joint 19, or a clamping device is provided, which encloses the overlapping ends with a clamp 20.

The completed frame 15 is moved to a feeder aggregate 21, where several frames 15, 15a, 15b, 15c can be stored on suitable supports 22. The adjoining rack is provided for working on two completed frame sizes without using the bending machine.

In this case the two feeder aggregates 21 and the additional feeder aggregate to the left of feeder aggregate 21 are moved back and forth on the rails, in order to reach the devices for the subsequent production steps, always in positions opposite from each other.

In subject case the feeder aggregate 21 is of importance, on which frames 15, 15a, 15b, 15c of different sizes can be stored.

The subsequent machine requests frame 15, which is pointing in the production direction, and which is taken off via feeder device 22a, whereby supports 23 intervene and accept the requested frame from feeder device 21. Feeder aggregate 22a is moved in the direction of arrow 24 on the rails 25, and the requested frame reaches production station 26 which is arranged in vertical direction.

The production station at this time consists of a centering and feeder table 27, a clamping table 28 and a table 28a as removal station.

Furthermore, the production station 26 consists of a turning and transport device 29 and of four clamping heads 30, 31, 32, 32a, whereby the fourth clamping head 32a is not in sight, since it is located at the rear left corner of clamping table 28.

Frames 15, 15a, 15b, 15c are horizontally positioned on clamping table 28 by the feeder device 22a via the rails 25.

The completed innersprings, which are to be connected to frame 15 arrive from the centering and feeder table 27. First each underside of each spring is clamped to the adjoining frame, then the entire innerspring, clamped at the underside, is turned around by the turning device 29 and, again, all undersides of the springs are clamped together.

Then the completed innerspring is transported to table 28a and removed in the direction of the arrow 33.

Instead of table 28a a conveyor belt can be used to remove the completed innerspring mattresses.

In detail, the production sequence is now as follows:

The innersprings without frames are positioned on the centering and transport table 27, whereby table 27 is equipped with suitable stops for positioning the innerspring, which are not described in detail. Following alignment the innerspring is taken up by transport device 34, which is equipped with clamping jaws 35, and the transport device 34 moves in direction of arrow 36 along the main frame 38.

Device 34 brings the innersprings to clamping table 28, where frame 15 is already in position.

Now the clamping heads 30, 31, 32, 32a come into action, whereby each spring 40 at its underside 41 is connected to the respective frame 15a by a clamp. Each clamping head is movable in one side, whereby clamping head 31 can be moved in direction of arrow 42, clamping head 30 in direction of arrow 43, clamping head 32 in direction of arrow 44, and clamping head 32a opposite to direction of arrow 42.

Following the connection of the spring undersides 40 with the frame 15 positioned underneath, the turning device 29 comes into action; the entire mattress is turned, and the clamping heads now connect the upper sides 46 of springs 40 (which are now positioned underneath) with another frame 15b, using the respective clamps.

Upon completion of the clamp connections at the upper and under side of the mattress, the mattress is moved via the turning and transport device 29 in the direction of arrow 49 to removal table 28a, and a new innerspring is brought to the clamping table 28 by the transport device 34; another frame 15c was already brought to the table by the transport device 22a.

Thus, transport station 22a first positions a single frame, for instance 15a on table 28, and an innerspring reaches the table 28 via the feeder device 27 with station 34. Then the clamping of the springs 40 with the frame 15a underneath occurs.

After completion of the clamping on the underside, transport device 29 moves in direction of arrow 49 to table 28a; here the turning station starts to function, i.e. the individual frame 15a clamped at the underside is turned around pivot point 50; in the meantime, feeder station 22a brings another frame 15b to the clamping table 28.

After turning the frame is returned to table 28 with the device 29.

Now frame 15b to be clamped is underneath and is clamped via the clamping stations 30, 31, 32, 32a, so that frame 15a, 15b is now clamped above and below, and the innerspring is located between the frames.

Now transport station 29 goes again into action and transports the completely clamped frames with the innerspring in direction of arrow 49 to the removal table 28a or the conveyor belt respectively.

In the meantime another frame 15c arrived at table 28 via feeder station 22a and is in the lower position, while another innerspring was laid on frame 15c, arriving from feeder station 27 and transport device 34; now the previously described clamping process takes place.

In a further development of subject invention an even faster synchronous application of this device works somewhat as follows:

Two different frames laying behind each other are connected to an innerspring, whereby in two consecutive steps only the undersides of these frames are connected to the respective innerspring.

This is accomplished as follows:

First one frame is positioned on table 28, and the innerspring is laid on the frame 15 by the transport device. Now the clamping of springs 40 at their undersides 41 occurs.

The completed frame is moved by device 29 to the left in the direction of arrow 49 and remains in waiting position above table 28a.

At the same time a new frame 15a reaches table 28 from the feeder station 22, and another innerspring is laid on this frame by transport device 34, and again frame 15a with springs 40 is clamped at the underside 41.

Then, this second completed frame is transported by device 34 to feeder table 27, where it remains in waiting position.

At the same time, the first frame, which was held in waiting position above table 28a by transport device 29, is returned; after turning, it is positioned on table 28, another frame 15b arrives from feeder station 22, and the clamping of the underside occurs.

The innerspring is now completed, is removed, and the frame waiting above table 27, which is only attached to the springs at its underside, is now turned around swivel point 51 of device 34 and is laid on table 28 in its turned position, where another frame 15c now arrives, and the undersides (previously upper sides) are clamped together.

This is a parallel synchronous operation, whereby two innersprings are worked on at the same time.

All functions of the frame bending machine such as band traction, bending and cutting are hydraulically performed and guarantee problem-free operation. Measuring rollers check the length of the incoming band material, and electronic control is provided. The frame bending radii are achieved by a simple method using varying center disks, which can be manually exchanged. The setting or changing of the bending rollers can simply be done from the front without disassembly of the surrounding parts.

A potentiometer controls the frame length; the desired frame length can be set by turning a potentiometer knob. Length and width input also occurs via the control unit.

In order to prevent start-up inertia or lagging of the plate, an individual drive with brake can be provided in the area of reel 13.

In summary, the combination of the production line as per the invention and the frame bending machine provides that innerspring mattresses can be assembled automatically in fast synchronous production sequences without hardly any manual interference. By simple programming of an operating unit various sizes of steel rods and band steel can be used, whereby high accuracy for lengths and angles is achieved in connection with program input using only a code number.

| DRAWINGS - LEGEND | |
|---|---|
| 1 | Rotor |
| 2 | Rollers |
| 2a | Wire alignment device |
| 3 | Wire |
| 4 | Measuring rollers |
| 5 | Traction rollers |
| 6 | Bending device |
| 7 | Fixed axis |
| 8 | Pin |
| 9 | Cutting device |
| 10 | Counter bearing |
| 11 | Centering plate |
| 12 | Operating unit |
| 13 | Reel |
| 14 | Frame bending machine |
| 15, 15a, 15b, 15c | Frames |
| 16 | Feeder |
| 17 | Direction of arrow |
| 18 | Butt welding device |
| 19 | Frame joint |
| 20 | Clamp |
| 21 | Feeder aggregate |
| 22 | Support |
| 22a | Feeder device |
| 23 | Support |
| 24 | Direction of arrow |
| 25 | Rail |
| 26 | Production station |
| 27 | Centering feeder table |
| 28 | Clamping table |
| 28a | Table |
| 29 | Turn and transport device |
| 30 | Clamping head |
| 31 | Clamping head |
| 32, 32a | Clamping head |
| | Direction of arrow |
| 34 | Transport device |
| 35 | Clamping jaws |
| 36 | Direction of arrow |
| 38 | Main frame |
| 39 | Clamping jaws |
| 40 | Spring |
| 41 | Underside |

-continued

| DRAWINGS - LEGEND | |
|---|---|
| 42 | Direction of arrow |
| 43 | Direction of arrow |
| 44 | Direction of arrow |
| 46 | Upper side |
| 49 | Direction of arrow |
| 50 | Pivot point |
| 51 | Swivel point |
| 52 | Center disk |
| 53 | Bending roller |
| 54 | Direction of arrow |
| 55 | Groove |
| 56 | Band steel |
| 57 | Band guide |

I claim:

1. An automatic frame bending machine for bending steel rod and band steel frame material into a frame configuration comprising, in combination:

a housing, said housing having a support surface defining a reference plane;

a reel disposed adjacent to said housing for holding and linearly dispensing a quantity of frame material;

a wire alignment apparatus mounted to said housing and positioned to receive frame material dispensed from said reel along a feed path, said feed path being disposed in a plane of bending located above and parallel to said reference plane, said wire alignment apparatus having a rotor for axially twisting a frame material, and support rollers for supporting a frame material for transport along said feed path;

measuring rollers mounted to said housing support surface and positioned along said feed path for measuring an amount of frame material dispensed from said reel;

traction rollers mounted to said housing support surface and positioned along said feed path for linearly driving a frame material along said feed path, said traction rollers being positioned to pull a frame material through said support rollers;

a bending device mounted to said housing support surface and positioned along said feed path for bending a frame material in said plane of bending, said bending device including a center disk having a circumferential groove formed therein and a bending roller pivotally mounted about said center disk and circumferentially positionable along said circumferential groove in accordance with a selected bending angle;

a cutting device mounted to said housing support surface and positioned along said feed path for cutting a frame material;

a centering plate mounted to said housing support surface and positioned along said feed path, said centering plate being configured for diverting a frame material in a direction substantially normal to said plane of bending to an output area;

hydraulic drive means for driving said traction rollers and said bending device; and control means for controlling said hydraulic drive means to drive said traction rollers and said bending device.

2. The automatic frame bending machine of claim 1, wherein said bending device has a fixed axis and a pin which is pivotally mounted about said fixed axis and positioned such that a frame material may be introduced between said axis and said pin.

3. The automatic frame bending machine of claim 1, wherein said cutting device includes a counter bearing.

4. The automatic frame bending machine of claim 1 wherein said centering plate is semi-circular in shape and arched upwardly from said plane of bending.

* * * * *

UNITED STATES PATENT AND TRADEMARK OFFICE

CERTIFICATE OF CORRECTION

PATENT NO. : 5,136,867

DATED : August 11, 1992

INVENTOR(S) : Jakob Zuger

It is certified that error appears in the above-identified patent and that said Letters Patent is hereby corrected as shown below:

TITLE PAGE, ITEM [22]

Please change the filing date from "Jan. 22, 1990" to --Jan. 22, 1991--.

Signed and Sealed this

Fifteenth Day of February, 1994

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,136,867

DATED : August 11, 1992

INVENTOR(S) : Jakob Züger

It is certified that error appears in the above-identified patent and that said Letters Patent is hereby corrected as shown below:

Title Page, Item [73]

Change the identification of the assignee from "Spuhl AG, Fed. Rep. of Germany" to --Spühl AG, St. Gallen, Switzerland--.

Signed and Sealed this

Second Day of August, 1994

*Attest:*

*Attesting Officer*

Bruce Lehman

BRUCE LEHMAN

*Commissioner of Patents and Trademarks*